US005115543A

United States Patent [19]

Föhl

[11] Patent Number: 5,115,543

[45] Date of Patent: May 26, 1992

[54] BUCKLE FOR SAFETY BELT SYSTEMS IN VEHICLES

[75] Inventor: Artur Föhl, Schorndorf, Fed. Rep. of Germany

[73] Assignee: TRW Repa GmbH, Alfdorf, Fed. Rep. of Germany

[21] Appl. No.: 793,166

[22] Filed: Nov. 18, 1991

[30] Foreign Application Priority Data

Dec. 11, 1990 [EP] European Pat. Off. ..... 90123817.0

[51] Int. Cl.[5] ..... A44B 11/25

[52] U.S. Cl. ..... 24/633; 24/635; 24/637

[58] Field of Search ..... 24/633, 634, 635, 636, 24/637, 638, 640, 641, 642, 643, 644, 647, 655, 656, 657; 242/107.4 R, 107.4 D

[56] References Cited

U.S. PATENT DOCUMENTS 3,233,296 2/1966 Whittingham ..... 24/637
3,255,502 6/1966 Hollins ..... 24/637
3,648,333 3/1972 Stoffel ..... 24/635
4,451,958 6/1984 Robben et al. ..... 24/641

FOREIGN PATENT DOCUMENTS 1317765 1/1963 France ..... 24/637

*Primary Examiner*—Victor N. Sakran
*Attorney, Agent, or Firm*—Tarolli, Sundheim & Covell

[57] ABSTRACT

The buckle for safety belts in vehicles provided with a pretensioner engaging said buckle is provided with a compensating mass which at the end of the pretensioning travel prevents a mass-inertia-induced movement of the release button in the actuating direction. The compensating mass is formed by a lever which is pivotally mounted on the housing and which comprises a gear element which is in permanent meshing engagement with a rack on the release button. On each actuation of the release button the lever is pivoted, the easy mobility thereof thereby being ensured even after a longer period of use of the buckle.

12 Claims, 4 Drawing Sheets

BUCKLE FOR SAFETY BELT SYSTEMS IN VEHICLES

The invention relates to a buckle for safety belt systems in vehicles which are provided with a belt pretensioner engaging on the buckle, a loadbearing housing in which an insert path for an insert tongue is formed, a locking bar which engages the insert tongue and is movable between a first position in which the insert tongue is blocked in the buckle and a second position in which the insert tongue is released from the buckle, a release button which is biased by spring force into a rest position and by actuation of which in the direction of the insert movement of the insert tongue, which corresponds to the tightening direction, into a release position the locking bar is moved into the second position, and a mass body which at the end of a pretensioning travel compensates the mass inertia of the release button.

Buckles for safety belt systems are known in numerous constructional forms. A constructional form has proven itself in which in the loadbearing housing of the buckle an insert path is formed for the insert tongue and a locking bar which is guided displaceably on the housing transversely of the insert path or pivotally mounted cooperates with a detent opening of the insert tongue. A blocking member guided displaceably parallel to the insert path in the housing holds the locking bar or bolt in its locking position as long as a release button likewise displaceably guided parallel to the insert path in the housing is in its rest position. Said release button is coupled to the blocking member to move the latter on actuation into a release position in which the locking bar comes free of the detent opening of the insert tongue.

The use of such a buckle in safety belt systems having a pretensioner is not problematical if the tightening force is active for example at the belt retractor. Pretensioners have also already been proposed which are effective between the buckle and its mounting point on the vehicle bodywork or a vehicle seat. Such pretensioners shorten the distance between the mounting point of the buckle and the buckle itself by a few cm, for example 10 cm.

The force required for the tightening can be generated mechanically by means of a strongly dimensioned spring or pyrotechnically. If the tightening force is of adequate magnitude, in particular when using pyrotechnical tightening drives, in certain cases when using a buckle of the type set forth above, an automatic opening at the end of the pretensioning travel may occur.

The automatic opening of the buckle at the end of the pretensioning movement is attributed to the mass inertia of the release button and possibly components engaging said button, because at the end of the pretensioning movement the release button tends to continue its movement in the pretensioning direction, which corresponds to the actuating direction of the release button. It has already been proposed to prevent this continued movement of the release button under the influence of inertial forces by employing pivotal compensating masses, mass bodies or blocking pawls.

If the buckle is provided with such a blocking pawl or compensating mass which becomes active at the end of the pretensioning motion due to mass inertia for preventing the movement of the release button in the actuating direction, said blocking pawl or compensating mass represents a component which during the life of the buckle never becomes active. It is only during a pretensioning operation, which possibly might not occur until ten years of use of the buckle, that the pawl or compensating mass is to move out of a rest position under the action of its mass inertia into a blocking position. It is generally held in its rest position by a spring. Now, there is no excluding the possibility that in the course of the long use life of the buckle impairments of the functionability of the pawl or compensating mass occur. For example, a pawl can be prevented by soiling or penetration of foreign bodies from moving out of its rest position into its blocking position.

Proceeding from this knowledge, the invention makes available a buckle for safety belt systems in vehicles which on every actuation of the release button ensures a constrained movement of the mass body. By this constrained movement of the mass body on every actuation of the release button the free mobility thereof is guaranteed even for long periods of time of ten or more years.

The buckle according to the invention for safety belt systems in vehicles is characterized in that on the release button or on a member connected at least in force-locking manner thereto at least one first gear element is formed, that on the mass body mounted movably relatively to the housing a second gear element is formed, that the first gear element and the second gear element are in meshing engagement with each other permanently directly or via an interposed third gear element, that the direction of the movement transmission between release button and mass body effected by the meshing engagement of the gear elements is so defined that the mass inertia of the mass body opposes the movement of the release button in the pretensioning direction, and that the mass body taking account of the transmission ratio between the toothing elements is so dimensioned that the inhibiting force generated thereby and opposing the movement of the release button in the pretensioning direction suffices to prevent a mass-inertia-induced movement of the release button into its release position at the end of the pretensioning movement of the buckle.

Due to the regular forced movement of the mass body on each actuation of the release button the buckle according to the invention is distinguished by an extremely high functional reliability in any pretensioning operation.

Several embodiments of the invention will now be described in detail with reference to the drawings, wherein.

Figure 1:
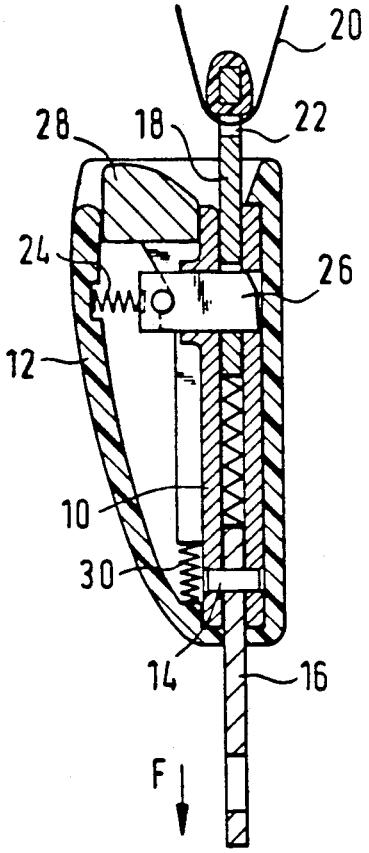
FIG. 1 is a schematic longitudinal section of a buckle for safety belts in vehicles in which the invention may be employed.
Figure 2:
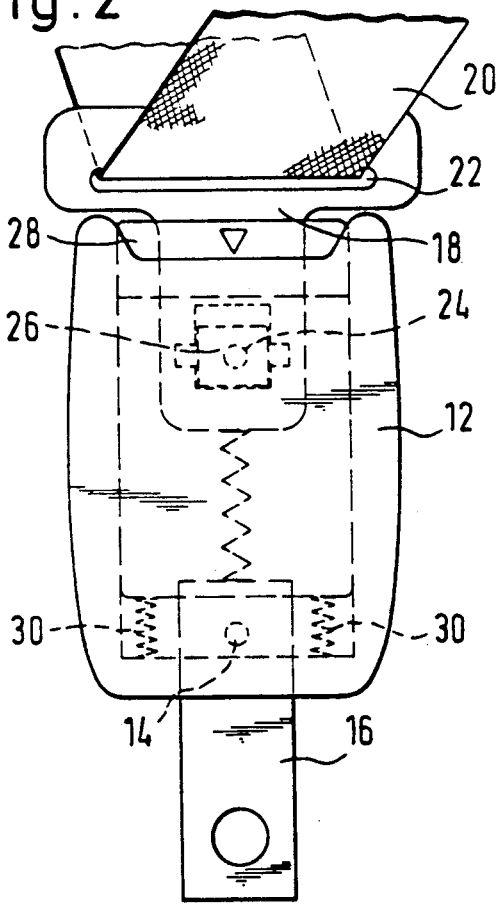
FIG. 2 is a schematic side elevation of the buckle shown in FIG. 1 shown partially in perspective.

In the embodiment of a buckle shown in FIGS. 1 and 2 for safety belts in vehicles a loadbearing housing 10 is surrounded by a cover shell 12 of plastic. The housing 10 is connected by a rivet 14 to a fitting 16 on which a tightening means (not shown) engages in known manner. On activation of said tightening means the buckle is shifted in the direction of the arrow F a few cm, for example 10 cm, towards the vehicle bottom. The loadbearing housing 10 is made from a generally U-shaped bent metal plate. Between the two legs of the housing 10 an insert path is formed for an insert tongue 18 of the safety belt system. The webbing 20 is guided by a slot 22 of the insert tongue 18.

A bolt or locking bar 26 loaded by a pressure spring 24 is guided displaceably transversely of the insert path of the buckle. In its position shown in FIG. 1 said locking bar passes through aligning openings of the housing 10 and the insert tongue 18. Between the inner side of the cover shell 12 and the housing 10 a release button 28 is displaceably guided. Said release button 28 is provided with a recess for the passage of the locking bar 26. The release button 28 is biased by at least one pressure spring 30 into its unactuated position shown in FIG. 1; in FIG. 2 two such pressure springs can be seen.

Figure 3:
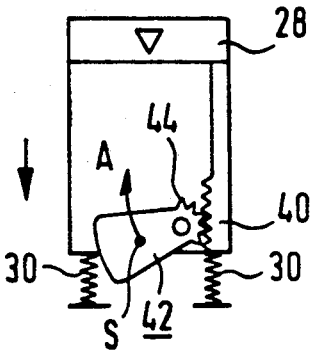
FIG. 3 is a sketch illustrating the operating principle of a first embodiment of the buckle according to the invention.
Figure 4:
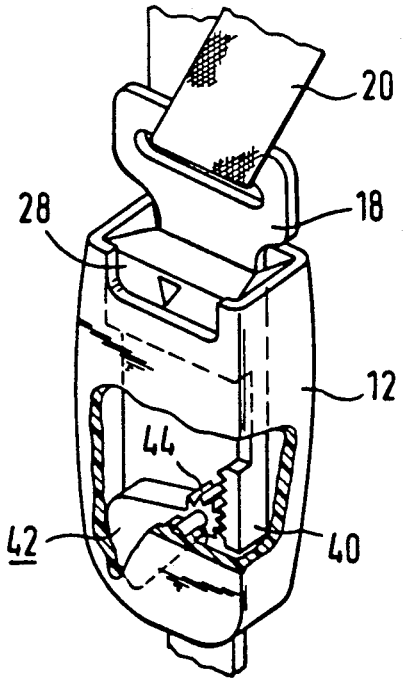
FIG. 4 shows a partially broken away perspective view of an embodiment based on the principle shown in FIG. 3.

In the embodiment of the buckle shown in FIGS. 3 and 4 a gear element in the form of a rack 40 is integrally formed on the release button 28. A lever 42 is pivotally mounted at the inner side of the housing shell 12. Said lever 42 forms a mass body with a center S of gravity located at a distance from the pivot bearing of the lever 42. A pinion segment 44 is integrally formed on the lever 42 concentrically with the pivot axis of said lever. Said pinion segment 44 is in permanent meshing engagement with the rack 40. On every actuation of the release button 28 the lever 42 is therefore pivoted oppositely to the movement direction of the release button 28. When at the end of a pretensioning operation in which the buckle is shifted by the pretensioner in the direction of the arrow F in FIG. 1 towards the vehicle bottom, the release button 28 tends due to its mass inertia to continue the movement in the direction of the arrow F, i.e. in a direction corresponding to its actuating direction for opening the buckle, the mass inertia of the lever 42 acts thereagainst because due to the direct meshing engagement between the rack 40 and the pinion segment 44 a movement of the release button 28 in the direction of the arrow F can take place only if the lever 42 is pivoted in the direction of the arrow A in FIG. 3. By dimensioning of the lever 42 and suitable arrangement of its center S of gravity relatively to its pivot axis, it is possible in simple manner to achieve complete compensation of the mass inertia of the release button 28. Since on each actuation of the release button 28 a pivoting of the lever 42 is forced to take place, the easy mobility thereof is ensured even after a long period of use of the buckle. Any stiffness in the movement of the lever 42 due for example to soiling or penetrated foreign bodies would result in the compensation of the mass inertia of the release button 28 being incomplete; due to the extremely high retardations which can occur at the end of the tightening travel at the buckle, there would then be a danger of automatic opening by shifting of the release button in the actuating direction. Due to the principle underlying the invention of producing a constrained movement of the mass body acting as compensating mass on every actuation of the release button, the compensation effect remains unimpaired even after a long period of use of ten years or more.

Figure 5:
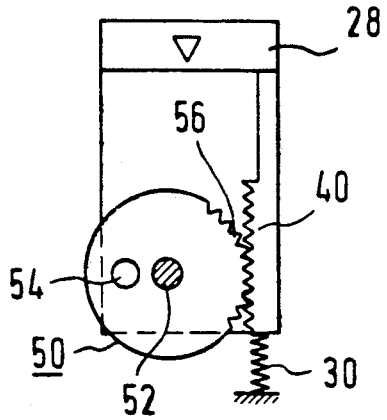
FIG. 5 is a sketch for illustrating the operating principle of a further embodiment of the invention.
Figure 6:
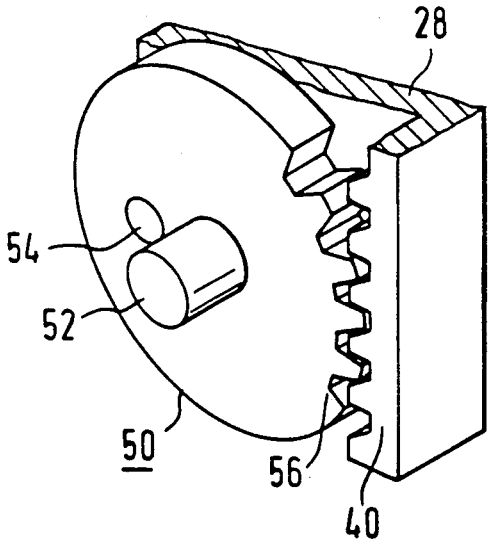
FIG. 6 is a partial perspective view of an embodiment based on the principle shown in FIG. 5.

In the embodiment according to FIGS. 5 and 6 a rack 40 is again arranged on the release button 28. However, the rack 40 is in meshing engagement with an externally toothed disc 50 which is rotatably mounted at least approximately in its center of gravity, which coincides with its center point, by means of a bearing pin 52 on the inner side of the cover shell 12 (not shown in FIGS. 5 and 6). Unbalances caused at the outer periphery of the disc 50 in the region of the external toothing 56 by the mass cut away there are compensated by a hole 54 in the body of the disc 50.

Because of the permanent meshing engagement between its toothing 56 and the rack 40, on each actuation of the release button 28 the disc 50 is set in rotation. Since the disc 50 is mounted for easy movement, the actuation of the release button 28 is in no way obstructed thereby. When however in particular at the end of a pretensioning travel the release button 28 tends due to its mass inertia to continue its movement, the direction of which corresponds to its normal actuating direction, the mass inertia of the disc 50 opposes this movement. Due to its mass inertia the disc 50 tends to retain its angular position in space. To accelerate the disc 50 to an angular velocity which corresponds to the velocity of the downward movement of the release button 28 at the end of the pretensioning travel, in accordance with the law of preservation of the angular momentum a high amount of energy would have to be spent. The disc 50 can easily be so dimensioned that the release button 28 will never be able to impart this energy. A particular advantage of the embodiment shown in FIGS. 5 and 6 resides in that because the disc 50 is mounted in its center of gravity it exerts an inibiting force on the release button 28 which is independent of the angular position of said disc and as a whole may have a relatively small mass because the angular momentum is in square law relationship with the radius on which the mass elements of the disc lie.

Figure 7:
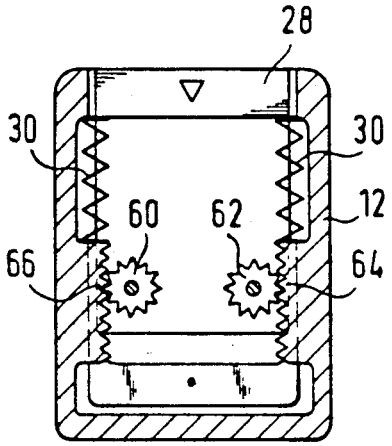
FIG. 7 is a schematic longitudinal section of a further embodiment to illustrate the principle underlying said embodiment.
Figure 8:
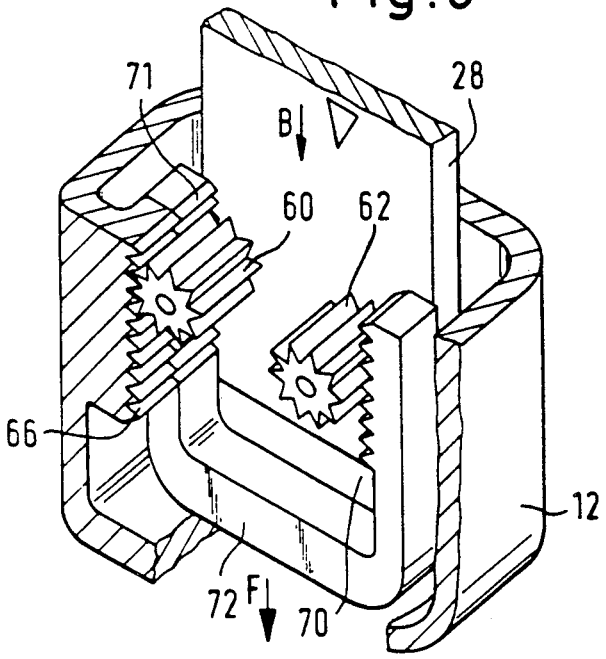
FIG. 8 is a perspective sectional view of the embodiment shown in FIG. 7.

In the embodiment according to FIGS. 7 and 8, two pinions 60, 62 are rotatably mounted on the release button 28. Said pinions 60, 62 are arranged symmetrically to the longitudinal axis of the buckle. Each pinion 60, 62 is in meshing engagement with an associated rack 64, 66 which is integrally formed on the inner side of the cover shell 12 and at the same time with a rack toothing 70, 71 on a leg of a U-shaped mass body 72. The pinions 60, 62 are arranged between the legs of the mass body 72. The mass body 72 is mounted displaceably in the actuating direction of the release button 28 relatively to the loadbearing housing 10. The release button 28 is urged by two pressure springs 30 into its rest position.

Due to the permanent meshing engagement between the pinions 60, 62 and the racks 64, 66 on the one hand and between said pinions and the rack toothings 70, 71 on the other, on each actuation of the release button 28 the pinions 60, 62 run in the direction of the arrow B in FIG. 8 on the racks 64, 66 and on the rack toothings 70, 71 and are moved downwardly with the release button. When this happens, the mass body 72 remains at rest. Consequently, it does not in any way impair the easy moving actuation of the release button 28.

When however at the end of a pretensioning travel the mass body 72 and the release button 28, due to their mass inertia, tend to continue the movement in the pretensioning direction denoted by the arrow F whilst the loadbearing housing 10 with the cover shell 12 is abruptly retarded, the rack toothings 70, 71 exert on the periphery of the pinions 60, 62 a moment of rotation which tends to rotate said pinions in a direction opposite to the direction of rotation which occurs when said pinions run on the racks 64, 66 on shifting of the release button in the actuating direction B. Thus, whereas the mass body 72 due to its meshing engagement with the pinions 60, 62 tends to cause the latter to run on the racks 64, 66 oppositely to the actuating direction B, i.e. upwardly in FIG. 8, due to its mass inertia the release button 28 tends to entrain the pinions 60, 62 via their bearing pins in the actuating direction B. The mass inertial forces exerted by the release button 28 on the one hand and the mass body 72 on the other thus counteract each other so that neither the release button 28 nor the mass body 72 is moved relatively to the housing or to the cover shell 12. There is therefore no possibility of unintentional opening of the buckle at the end of the pretensioning travel.

Due to its symmetrical structure, the embodiment shown in FIGS. 7 and 8 is distinguished by high mechanical stressability. The space requirement for accommodating the pinions and the mass body is small, especially since the mass body 72, although it is movable in the longitudinal direction relatively to the loadbearing housing and the cover shell, practically does not change its position relatively to the housing and the cover shell.

Figure 9:
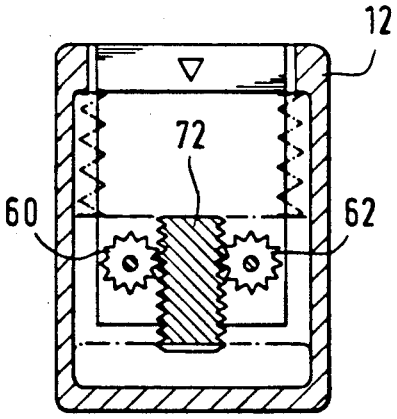
FIG. 9 is a sketch showing a modification of the embodiment according to FIGS. 7 and 8.
Figure 10:
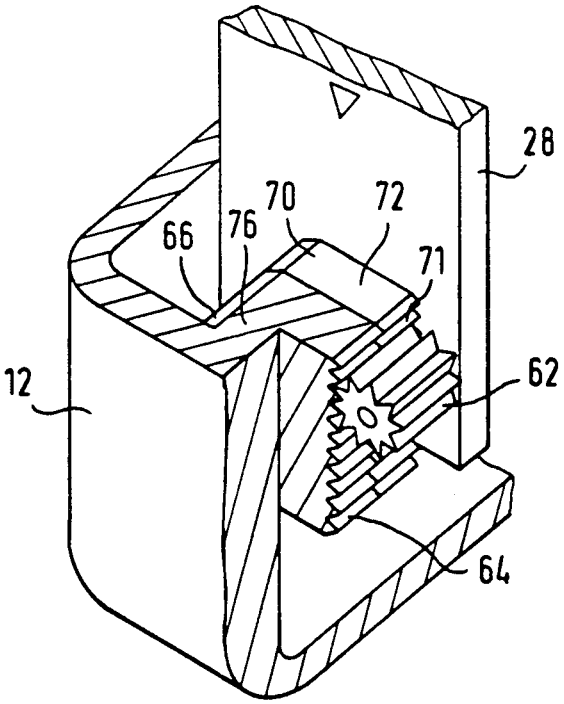
FIG. 10 is a perspective sectional view of the embodiment shown in FIG. 9.

In the embodiment according to FIGS. 9 and 10 the mass body 72 is made rod-like and located between the pinions 60, 62. Furthermore, the racks 64, 66 are integrally formed on a longitudinally extending rib 76 of the cover shell 12. Otherwise, the construction and mode of operation of this embodiment are the same as those of the embodiment according to FIGS. 7 and 8.

Figure 11:
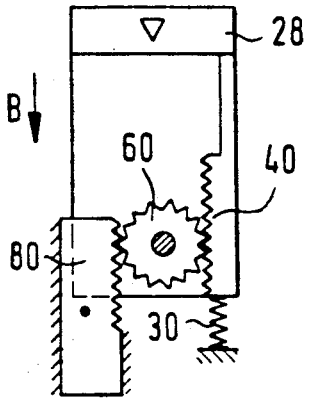
FIG. 11 is a sketch for illustrating the operating principle of a further embodiment.

The embodiment shown in FIG. 11 is very similar to that of FIGS. 2 and 3. In deviation therefrom, however, the toothing element with which the rack 40 is in meshing engagement is formed as pinion 60 rotatably mounted at the inner side of the cover shell. Said pinion 60 is in permanent meshing engagement with the toothed strip 40 and a toothing on a rod-shaped mass body 80. The mass body 80 is mounted displaceably in the longitudinal direction relatively to the loadbearing housing and the cover shell of the buckle. On each movement of the release button 28 in the actuating direction B the pinion 60 is set in rotation. Since the center point of the pinion 60 is fixed on the cover shell of the buckle, on rotation of the pinion the mass body 80 must move oppositely to the movement of the release button 28. Due to the permanent meshing engagement between the pinion 60, the rack 40 and the toothing of the mass body 80, the inertial forces of the release button 28 and mass body 80 counteract each other. Therefore, at the end of a pretensioning travel the mass inertia of the mass body 80 prevents any further movement of the release button 28 in the actuating direction B relatively to the housing and cover shell of the buckle.

Figure 12:
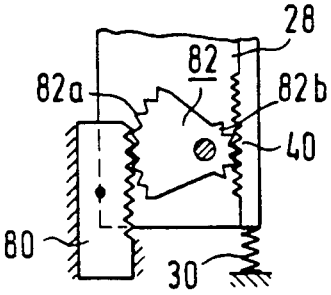
FIGS. 12, 13 and 14 are sketches to illustrate the operating principle of further embodiments.
Figure 13:
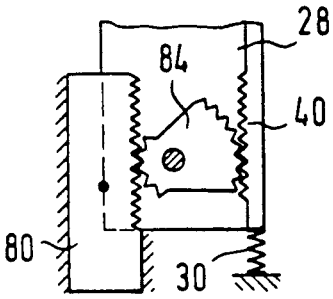

The embodiments according to FIGS. 12 and 13 differ from that of FIG. 11 in that the pinion 60 is replaced by a gear element 82 or 84 which comprises two arcuate gear segments **82*a*, 82*b* which are located at a different distance from the pivot bearing of the gear element 82. The gear element 82 therefore effects a magnification or reduction between the movements of the release button 28 and the mass body 80 taking place in the longitudinal direction of the buckle, depending on the ratio of the distances of the gear elements 82*a*, 82*b* from the bearing axis of the gear element 82. In the embodiment according to FIG. 12 the movement of the release button 28 is translated via the gear element 82 into a greater movement of the mass body 80; in the embodiment according to FIG. 13, however, the movement of the release button 28 is reduced to a smaller movement of the mass body 80. As a comparison of FIGS. 12 and 13** shows, the magnitude of the mass body may be adapted to the magnification or reduction ratio.

In the embodiments according to FIGS. 14 to 17 on the inner side of the cover shell of the buckle two pinions 60, 62 are rotatably mounted. As in the embodiment according to FIGS. 7 and 8 or 9 and 10, the release button 28 is provided with two integrally formed racks 64, 66. The rack 64 is in meshing engagement with the pinion 62, and the rack 66 is in meshing engagement with the pinion 60. At the same time, the pinions 62, 60 are in meshing engagement with oppositely disposed toothings 70, 71 of a mass body 72. The mass body 72 is displaceably mounted in the longitudinal direction relatively to the housing of the buckle and to its cover shell. The mode of operation is the same as that in the embodiment according to FIG. 11 and will therefore not be explained again. By using two symmetrically arranged pinions 60, 62 and racks 64, 66 with a likewise symmetrically formed mass body disposed between the pinions, a high mechanical loadability is achieved.

Figure 14:
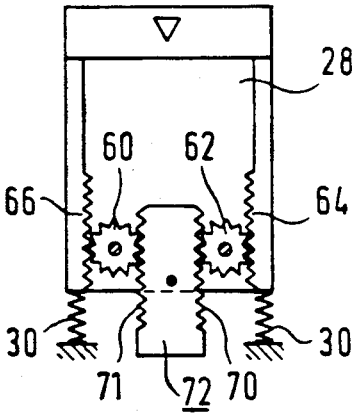
Figure 15:
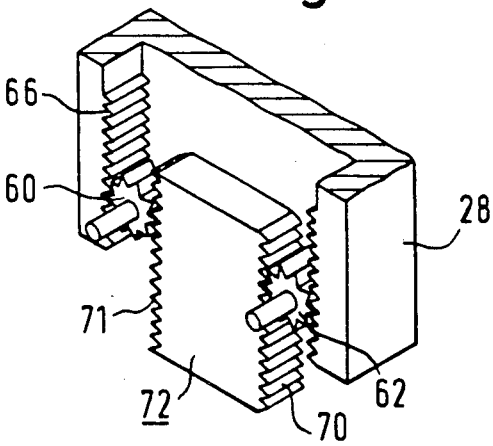
FIG. 15 is a perspective partial view of an embodiment based on the principle shown in FIG. 14.
Figure 16:
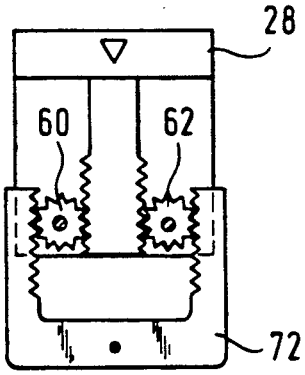
FIG. 16 is a sketch showing a modification of the embodiment according to FIGS. 14 and 15.
Figure 17:
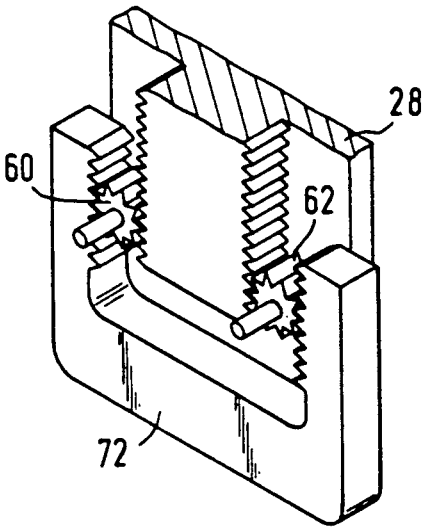
FIG. 17 is a partial perspective view of the embodiment according to FIG. 16.

In the embodiment according to FIGS. 16 and 17 the mass body 72 is not rod-shaped as in FIGS. 14 and 15, but made U-shaped and the pinions 60, 62 are arranged between the legs of the U-shape. In this embodiment as well the pinions 60, 62 are rotatably mounted on the inner side of the cover shell. The mode of operation of this embodiment is fundamentally the same as that in the embodiment according to FIGS. 14 and 15.

I claim:

1. A buckle for safety belt systems in vehicles which are provided with an insert tongue for cooperation with said buckle and with a belt pretensioner engaging on the buckle, comprising a loadbearing housing in which an insert path for said insert tongue is formed, a locking bar which engages said insert tongue and is movable between a first position in which said insert tongue is blocked in the buckle and a second position in which said insert tongue is released from the buckle, a release button movable between a rest position and a release position and biased by spring force into said rest position, actuation of said button to said release position in a direction corresponding to an insert movement of the insert tongue, which in turn corresponds to a movement direction of said buckle in a pretensioning operation, causing said locking bar to be moved into said second position, and an inertial mass body for compensating the mass inertia of the release button, said release button being connected with at least one first gear element, said mass body being mounted movably relatively to the housing and having a second gear element formed thereon, said first gear element and said second gear element being in meshing engagement with each other permanently directly or via an interposed third gear element, and the meshing engagement between said gear elements causing the mass inertia of the mass body to oppose movement of the release button in said movement direction of the buckle to prevent the release button from moving to its release position at the end of said pretensioning operation.

2. The buckle according to claim 1, wherein said first and said second gear element are in direct meshing engagement with each other and the mass body is formed as lever which is pivotally mounted about a pivot axis on a housing-fixed part and comprises the second gear element as a pinion or pinion segment, said pinion or pinion segment having a center which coincides with said pivot axis.

3. The buckle according to claim 1, wherein said first gear element is formed as a rack in direct meshing engagement with said second gear element, and the mass body being formed as an externally toothed disc which is mounted at least approximately in its center of gravity rotatably on a housing-fixed part.

4. The buckle according to claim 1, wherein said first gear element is formed as a pinion and is mounted rotatably on the release button in direct meshing engagement with said second gear element formed as a rack and arranged on the mass body, and at the same time with a housing-fixed rack, and the mass body being mounted translationally displaceably relatively to the housing.

5. The buckle according to claim 4, wherein two pinions are rotatably mounted on the release button and are both in meshing engagement with a respective rack portion on the mass body and at the same time with a respective housing-fixed rack element.

6. The buckle according to claim 5, wherein said mass body is rod-shaped and is arranged between said pinions.

7. The buckle according to claim 5, wherein said mass body is U-shaped and said pinions are arranged between the legs of the U-shape.

8. The buckle according to claim 1, wherein said third gear element is a pinion, said first gear element being formed as a rack member arranged on the release button and in meshing engagement with said second gear element likewise formed as a rack element and arranged on the mass body guided translationally displaceably relatively to the housing.

9. The buckle according to claim 8, wherein said release button has two rack portions in meshing engagement with a respective pinion mounted rotatably relatively to the housing, and the mass body having two rack portions in meshing engagement with a respective one of the two pinions.

10. The buckle according to claim 9, wherein said mass body is rod-shaped and is arranged between the two pinions.

11. The buckle according to claim 9, wherein said mass body is U-shaped and the pinions are arranged between the legs of the U-shape.

12. The buckle according to claim 1, wherein said mass body is guided translationally displaceably relatively to the housing and said third gear element is pivotally mounted on an axis relatively to the housing and has two arcuate toothing sections which are located at different distances from said axis, one of said toothing sections being in meshing engagement with a rack portion on the release button and the other in meshing engagement with a rack portion on the mass body.

* * * * *